US005759380A

United States Patent [19]

Jackson

[11] Patent Number: 5,759,380

[45] Date of Patent: Jun. 2, 1998

[54] METHOD OF PREPARING OXIDATION RESISTANT COATINGS

[75] Inventor: Melvin Robert Jackson, Schenectady, N.Y.

[73] Assignee: General Electric Company, Schenectady, N.Y.

[21] Appl. No.: 332,929

[22] Filed: Apr. 4, 1989

[51] Int. Cl.[6] ..... C23C 28/02; C25D 5/12

[52] U.S. Cl. ..... 205/178; 205/191; 205/228

[58] Field of Search ..... 204/37.1, 38.5, 204/40; C25D 5/12, 5/50

[56] References Cited

U.S. PATENT DOCUMENTS 3,692,554 9/1972 Burgardt et al ..... 204/38.5 X 3,817,793 6/1974 Kuhlman et al. ..... 136/236

3,918,139 11/1975 Felten ..... 29/194

3,922,396 11/1975 Speirs et al. ..... 427/250

4,123,595 10/1978 Chang ..... 428/667

4,477,538 10/1984 Clarke ..... 428/656

*Primary Examiner*—John F. Niebling

*Assistant Examiner*—William T. Leader

*Attorney, Agent, or Firm*—Noreen C. Johnson; Douglas E. Stoner

[57] ABSTRACT

A method of forming a protective coating of a CrRuAl alloy is provided. The substrate to be coated is first plated with a combination of chromium and ruthenium. Next, the coated substrate is aluminized with fine aluminum powder in an aluminum oxide pack at about 1150° C. The coating formed is resistant to atmospheric attack and protects the substrate.

5 Claims, 2 Drawing Sheets

METHOD OF PREPARING OXIDATION RESISTANT COATINGS

CROSS REFERENCE TO RELATED APPLICATIONS

The subject application relates to applications Ser. No. 202,357, filed Jun. 6, 1988; Ser. No. 208,905, filed Jun. 20, 1988; Ser. No. 214,078, filed Jul. 1, 1988; Ser. Nos. 279,639, 279,640, and 280,085, filed Dec. 5, 1988; Ser. No. 290,399, filed Dec. 29, 1988; Ser. No. 288,394, filed Dec. 22, 1988; and Ser. No. 288,667, filed Dec. 22, 1988. The texts of the copending applications are incorporated herein by reference.

BACKGROUND OF THE INVENTION

Copending application Ser. No. 214,078, filed Jul. 1, 1988, describes a family of metallic coating materials which can be employed to coat metals which might otherwise be subject to environment attack including oxidation. The subject application essentially represents an improvement over the method of the copending application. It is particularly directed toward an improved method of forming coatings, the composition of which corresponds to one of those enclosed within the envelope "A" of the accompanying FIG. 1, essentially, as described in the copending application Ser. No. 214,078.

The copending application describes in general terms the composition of coatings which are protective of substrate materials and particularly niobium-based substrate materials which may be employed in forming articles such as parts of jet engines to be employed at elevated temperatures. As described in the copending application, such coatings may be formed, for example, by plasma spray deposition of the coating material onto the substrate material.

However, problems arise when the part to be employed has re-entrant surfaces or has a configuration which does not accommodate itself to a coating by a direct method such as a plasma spray deposition method. Some parts employed in jet engines may have internal surfaces, for example, and such internal surfaces may nevertheless have to be protected by a surface coating to impede or prevent the attack of oxygen on the substrate material.

BRIEF STATEMENT OF THE INVENTION

It is accordingly one object of the invention to provide a method which permits protective metallic coatings to be formed on substrates which have need of such protection.

Another object is to provide a method by which protective coatings may be formed on surfaces which are internal surfaces of articles.

Another object is to provide a method which yields useful coatings at low cost and with high reliability.

Other objects will be in part apparent and in part pointed out in the description which follows:

In one of its broader aspects, objects of the invention can be achieved by first depositing a metal from the group consisting of chromium and ruthenium onto a receiving substrate surface. After application of the first one of these two metals by electrodeposition, the other of the two metals is then electrodeposited over the first. The total thickness of both deposits is preferably between ½ of a mil and one mil. Preferred ratio of the ruthenium to chromium in the layer is between about 55 to 70% chromium (by volume) and the remainder ruthenium.

After the layer has been formed the material is then aluminized for a few hours at a temperature above 1100° C., for example about four hours at about 1150° C. The aluminizing is carried out with an aluminum pack containing between 3 and 8 weight % of an aluminum source material, such as aluminum metal powder, or the Ti-Al-C mixtures known as Codep, in aluminum oxide powder. The aluminum source material must be a fine powder. A decomposable halide such as ammonium fluoride powder is also included in the pack to the extent of about 0.5 to 5 volume percent, and the sample to be aluminized is essentially buried in a mix of the fine aluminum and alumina powders and the ammonium fluoride. The ammonium fluoride decomposes and the aluminum of the aluminum powder is transported to the surface of the metal part where it is combined with the surface coating of ruthenium and chromium which is already present on the surface. The result is an aluminized coating of Cr, Ru and Al. What is sought in forming such a layer is the formation of a two-phase mixture of bcc Cr and RuAl. Such a mixture has high stability at high temperature in air.

BRIEF DESCRIPTION OF THE DRAWINGS

The invention and the description thereof which follows will be understood with greater clarity by reference to the accompanying drawings in which.

DETAILED DESCRIPTION OF THE INVENTION

Figure 1:
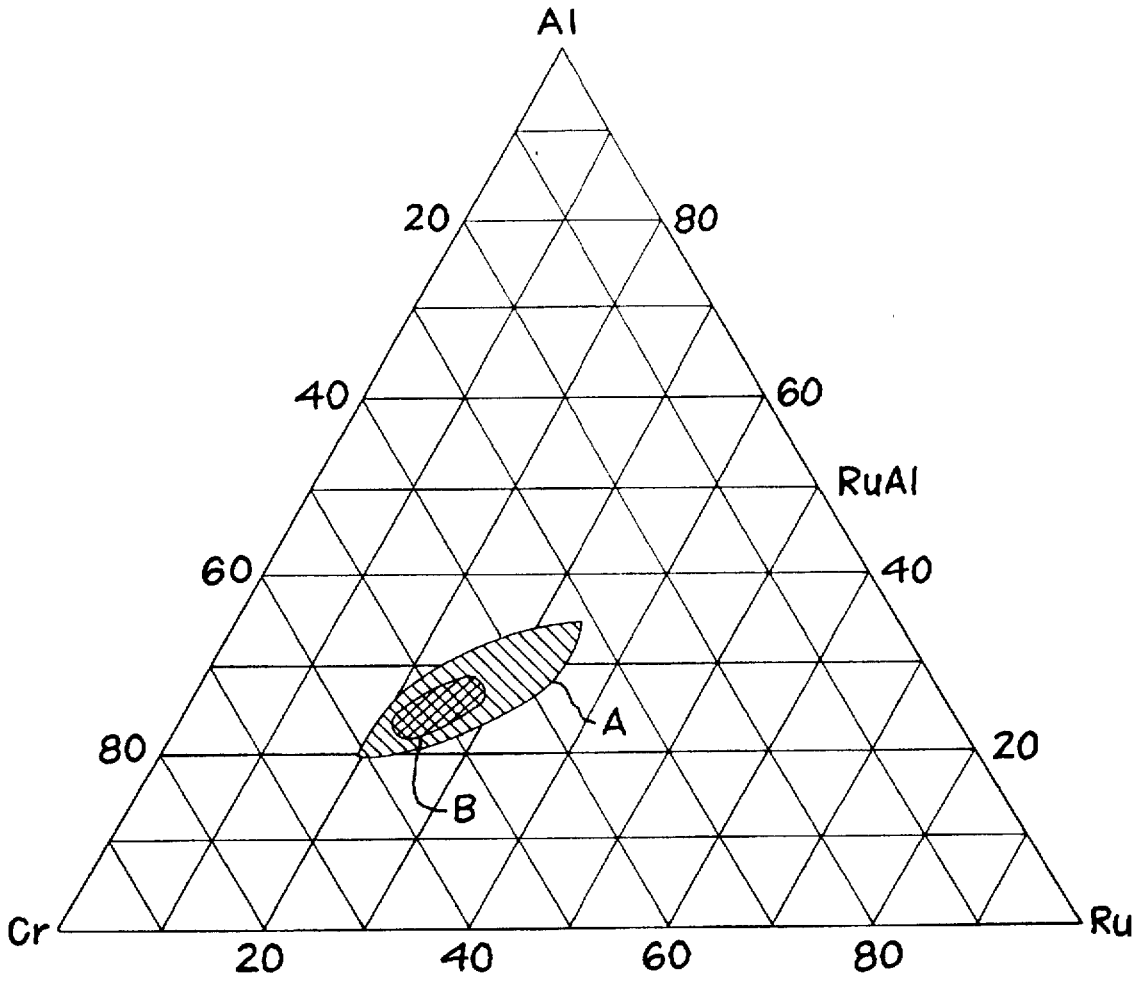
FIG. 1 is a graph of the CrRuAl ternary system showing compositions with oxidation resistance at temperatures as high as 1500° C. (2730° F.)

Pursuant to the present method, coatings which are protective against oxidation of a substrate metal are provided. The coatings which can be formed correspond to the coatings which are described in the copending application Ser. No. 214,078. However, the precise formula of the coatings is not known because the aluminizing technique does not permit determination of precisely the composition of the protective coatings which are formed by this technique. The method is, however, effective in forming coatings and a coating composition can be any one within the range of compositions which are described in the copending application and, accordingly, may have a composition as enclosed within curves A or B of FIG. 1.

In another aspect of the invention, certain modifications may be made to the above composition by substituting other metals for at least part of the ruthenium and/or chromium. Metals which can be substituted for ruthenium in the above composition include iron, nickel and cobalt. The elements iron, nickel and cobalt all have very large solubilities in the hexagonal close packed ruthenium crystal structure, especially at high temperatures. The three elements, iron, nickel and cobalt, form aluminides of the B2 ordered body centered cubic structure. This is the same structure as the RuAl of the above composition and the solubility of these three substituent metals, iron, nickel and cobalt, in the RuAl aluminide is deemed to be substantial.

In this other aspect of the invention, the substituent metals, iron, nickel and cobalt, are at least partially substituted in the electroformed layer in the place of ruthenium. Also, in this other aspect, the iron can be substituted to a limited degree for chromium.

Pursuant to this other aspect of the invention, iron, nickel and cobalt, either individually or in any combination, can be substituted into the CrRuAl up to about 15 atomic percent for nickel and cobalt and up to 20% for iron.

This resultant composition which is thought to be detained is written as follows:

$$(Ru_{(19-x)/o(34-x)}(\Sigma Fe+Ni+Co)_x Al_{(19)/o(34)} \cdot Cr_{(62-y)/o(32-y)} Fe_y$$

wherein Σ is a symbol indicating that the sum of the concentrations of the iron, nickel and cobalt present add up to the concentration x in atom percent, and wherein the value of x is between 0 and 15, and wherein the value of y is between 0 and 5 atom percent, and wherein the total value of the expression in atom percent is 100.

For each of these compositions it is contemplated that minor inclusions of other elements as an impurity will and does occur in the conventional processing of the compositions. It is also contemplated that other elements which do not detract from the properties of the compositions may be included as well.

EXAMPLE 1

A pin of pure niobium metal was provided.

The pin dimensions were about 2 inches long by ¼ inch diameter.

The pin was coated by first depositing chromium to a thickness of ½ mil and by then electrodepositing ruthenium to a thickness of an additional ½ mil so that the total thickness of the deposit formed was about 1 mil. This pin with its coating was then aluminized for four hours at 1150° C. The aluminizing pack contained 5.8 weight percent of fine aluminum powder in aluminum oxide containing ammonium fluoride. The pin was removed from the aluminizing pack and was observed to have a bright shiny surface. The exact chemistry of the aluminized structure formed by the aluminizing of the chromium and ruthenium layer was not known.

The pin sample thus prepared was heated in air to 1300° C. for 5 hours.

Figure 2:
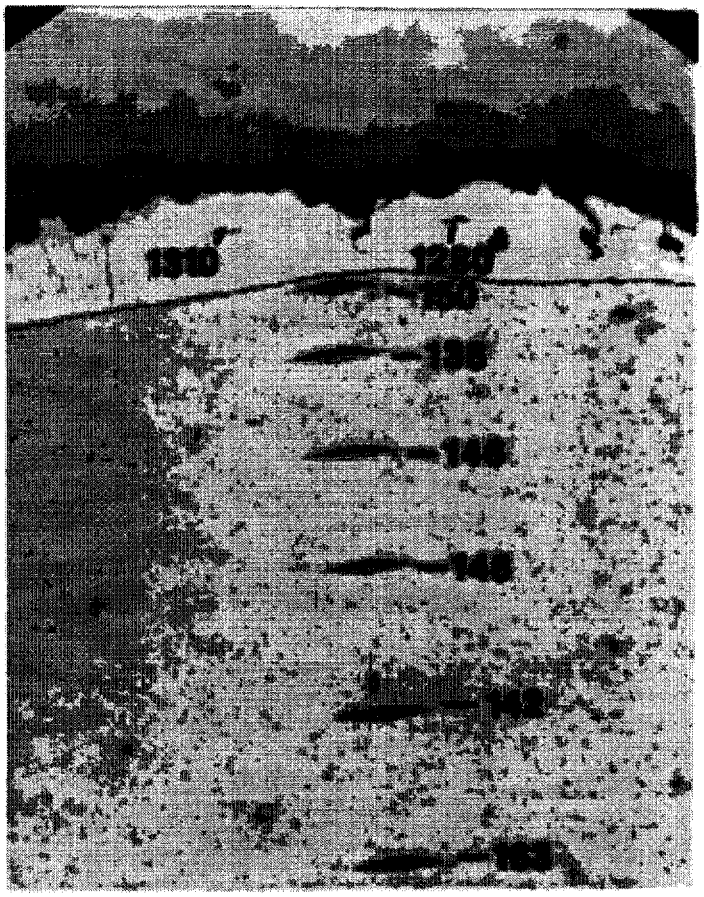
FIG. 2 is a photomicrograph showing a coating formed pursuant to the present invention and also showing a substrate beneath that coating with values of hardness overlaid over the photomicrograph to show the hardness of different zones beneath the coating formed on the substrate surface.

Following the exposure to the oxidation in air, the sample was sectioned and a microhardness trace was taken. This trace is illustrated in FIG. 2. The figure is a metallographic section of the pin showing the deposited protective coating at the upper part of the photograph and showing the core of the pin extending down to the remainder of the photograph. The markings on the photograph surface are of microhardness measurements made of the sample. The surface coating is seen to have a measured hardness of 1310 and 1280 kilograms per square millimeter. The substrate has measurements extending from 150 to 163 kilograms per square millimeter with a random variation through the depth of the pin. The microhardness trace established that the coating was protective of the substrate pin because it is well known that if oxygen or nitrogen had penetrated the coating, the niobium would have been embrittled and the hardness resulting would be in excess of 1000 kilograms per square millimeter. As is evident from the photograph of FIG. 2, the microhardness measurements were in the order of 150 kilograms per square millimeter and, accordingly, demonstrate that the embrittling of the niobium substrate did not occur and, accordingly, that the coating did protect the substrate.

Obviously, no oxidation took place and further, there was no oxygen or nitrogen permeation which hardened the substrate.

What is claimed is:

1. A method of forming a protective CrRuAl based coating on a shaped substrate which comprises, electrodepositing one of the metals from the group consisting of chromium and ruthenium onto the substrate surface, electrodepositing the other of the metals from the group onto the coated substrate, immersing the electroplated shaped substrate in a powder pack consisting of aluminum oxide, an aluminum source material, and a decomposable halide, heating the powder pack including the shaped substrate which it contains to above 1100° C. for a few hours, thereby to aluminize the electrodeposited chromium and ruthenium layer into a protective layer of chromium, ruthenium and aluminum.

2. The method of claim 1, in which the aluminum source material is finely divided aluminum powder.

3. The method of claim 1, in which the decomposable halide is ammonium fluoride.

4. The method of claim 1, in which the heating is at 1150° C. for 4 hours.

5. The method of claim 1, in which the Cr is 55 to 70 volume percent of the Cr, Ru layers.

* * * * *